United States Patent [19]

England

[11] 4,284,154

[45] Aug. 18, 1981

[54] NON-ROTATING SPRING LOADED STABILIZER

[75] Inventor: John R. England, Ontario, Canada

[73] Assignee: Inco Limited, Toronto, Canada

[21] Appl. No.: 95,318

[22] Filed: Nov. 19, 1979

[30] Foreign Application Priority Data

Jul. 19, 1979 [CA] Canada ..... 332121

[51] Int. Cl.[3] ..... E21B 17/10

[52] U.S. Cl. ..... 175/325; 166/241

[58] Field of Search ..... 175/325, 73, 79, 81; 166/242, 241, 138, 216; 308/4 A

[56] References Cited

U.S. PATENT DOCUMENTS

| | | | |
|---|---|---|---|
| 2,589,534 | 3/1952 | Buttolph | 175/325 |
| 2,696,367 | 12/1954 | Robishaw | 175/325 |
| 2,832,419 | 4/1958 | Webber | 166/216 |
| 2,929,453 | 3/1960 | Conrad | 166/138 |
| 3,080,924 | 3/1963 | Baker et al. | 166/241 |
| 3,104,134 | 9/1963 | Nielsen et al. | 175/325 |
| 3,370,657 | 2/1968 | Antle | 175/325 |

FOREIGN PATENT DOCUMENTS

| | | | |
|---|---|---|---|
| 1221024 | 5/1960 | France | 175/325 |
| 851036 | 10/1960 | United Kingdom . | |

*Primary Examiner*—James A. Leppink

*Attorney, Agent, or Firm*—Raymond J. Kenny; Edward A. Steen

[57] ABSTRACT

There is provided a non-rotating, self-centering stabilizer (10). The stabilizer (10) includes a cylindrical sleeve (12) disposed about a rotating mandrel (34). A plurality of wear-resistant pads (18A, 18B and 18C) partially extend from a similar number of longitudinal channels (14A, 14B and 14C) to form a stabilizing relationship with the wall of a hole being drilled.

10 Claims, 3 Drawing Figures

NON-ROTATING SPRING LOADED STABILIZER

TECHNICAL FIELD

This invention relates to drilling in general and more specifically to non-rotating apparatus for stabilizing drill bits, earth-rock cutting tools, and associated equipment within a hole.

BACKGROUND ART

A major problem facing members of the drilling industry has been the necessity of maintaining a straight and true hole. Due to a number of debilitating factors, a drill bit may tend to deviate from the path originally set for it. For example, surface conditions, underlying rock formations and worn-out equipment may contribute to the undesirable problem of drill deviation.

In relatively shallow holes, the angle of deviation is generally not pronounced and oftentimes it may be ignored. However, in deep holes, the deviation may amount to twenty-five degrees or more. Indeed, it has been reported that a hole, initially started in a vertical direction, had deviated seventy degrees at a depth of 1000 feet.

As a consequence to the above, various types of drill stabilizers have been developed to maintain straight line drilling. A common stabilizer is the roller-type stabilizer. Generally, it is annular in shape having a plurality of rollers attached to the periphery of the annulus. These devices are sequentially positioned above the drill bit. The rollers are undersized so that the diameter of the drill bit is slightly larger than the diameter of the rollers to accommodate eventual bit wear. As a result of this design, the rollers exert equal pressure against the walls of the hole as the bit proceeds to drill. The stabilizers act as a stabilizing influence on the bit and they prevent it from wobbling and hunting within the hole. Other examples of stabilizers include friction or drag types and marine bearing types.

Unfortunately, however, the stabilizers presently available do not have the ability to maintain a close contact tolerance with the hole diameter because of the wear and erosion experienced by the rollers. This debilitating wear occurs primarily because as the rollers rotate within the hole above the bit, they are constantly in rotational, frictional contact with the hole wall. This wearing action eventually results in increased tolerances between the rollers and the wall, thus reducing the effectiveness of the stabilizers. This loss of stability in the hole results in increased bit deviation and in additional drilling costs.

Furthermore, as alluded to earlier, in many drilling applications, the stabilizers presently available cannot be used effectively due to the undersizing of the stabilizers in relation to the drill bit. As the bit wears down, eventually the stabilizers will jam against the wall of the hole thereby interfering with the drilling process.

Therefore, a conventional stabilizer must be downsized initially to accommodate drill wear. Unfortunately, this results in a sloppy fit within the hole, substantially reducing the effectiveness of the stabilizer.

SUMMARY OF THE INVENTION

The disclosed invention surmounts the aforementioned difficulties.

Accordingly, there is provided a non-rotating, self-centering stabilizer. The stabilizer includes a cylindrical sleeve disposed about a rotating mandrel. A plurality of detachable, spring-loaded, wear-resistant pads partially extended from the external surface of the sleeve to form a stabilizing and contiguous relationship with the wall of a hole being drilled. Suitable mounting means are provided to connect the stabilizer to associated drill string components.

PREFERRED MODE FOR CARRYING OUT THE INVENTION

Figure 1:
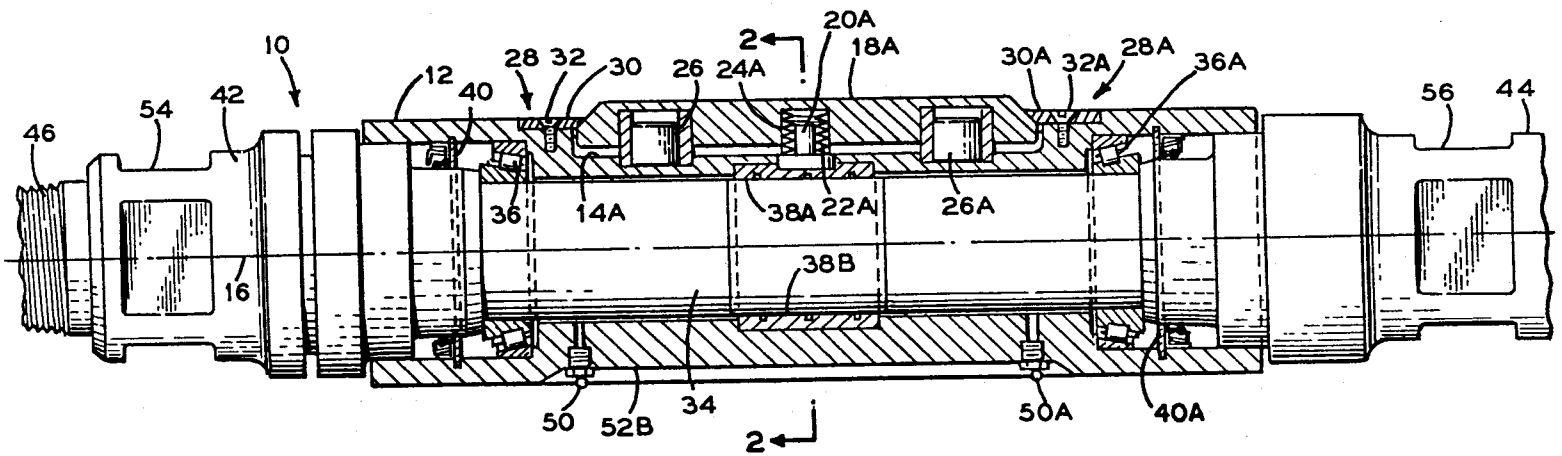
FIG. 1 is a sectional view of the invention.
Figure 2:
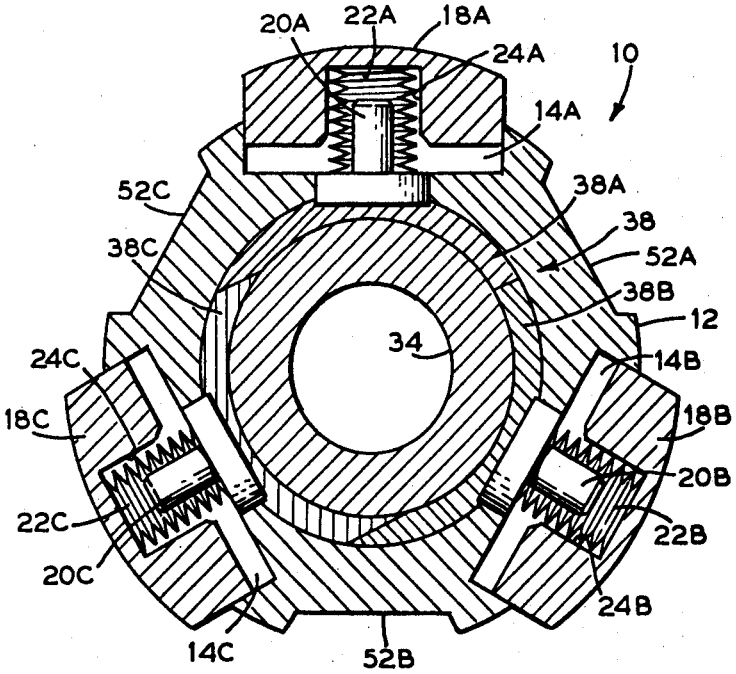
FIG. 2 is a cross-sectional view taken along lines 2—2 of FIG. 1.

Referring to FIGS. 1 and 2, there is shown a non-rotating spring loaded stabilizer 10. The stabilizer 10 includes cylindrical sleeve 12 and a plurality of longitudinal channels 14A, 14B and 14C formed along the external surface of the sleeve 10. Disposed between the channels 14 are a series of longitudinal troughs 52A, 52B and 52C. Line 16 is the axis of symmetry of the sleeve 12.

Detachably disposed within each the channels 14A, 14B and 14C, are corresponding wear-resistant pads 18A, 18B and 18C. The pads 18A, 18B and 18C may be constructed from a hard steel such as CHT 360 steel. However, depending on the contemplated service conditions, the pads may be made from any suitable abrasive alloy and/or be studded with carbide buttons or diamond chips. Resilient means, mechanical, pneumatic or hydraulic, are utilized for movably supporting the pads.

In the illustrated embodiment, spring washer retainers 20A, 20B and 20C are affixed to and project from the sunken surface of each of the channels 14A, 14B and 14C. Spring washers 22A, 22B and 22C are each oriented about a corresponding retainer 20A, 20B and 20C and are fitted into respective cavities 24A, 24B and 24C to allow the pads 18A, 18B and 18C to "float" in a spring loaded relationship within the channels 14A, 14B and 14C. Pad supports 26 and 26A (only two are shown) act as guides for the pads 18A, 18B and 18C as the pads move within the chnnels 14A, 14B and 14C.

Throughout the remainder of this specification, components having ancillary letters (i.e., 18A, 18B and 18C) will be referred to by their generic number (18).

Retaining means 28 and 28A serve a dual purpose. Firstly, due to the geometry of the pads 18 and the wedge shaped retaining plates 30 and 30A, the pads 18 are free to travel in a direction substantially perpendicular to the axis of symmetry 16. Secondly, by removing fasteners 32 and 32A and the retaining plates 30, the pads 18 may be expeditiously detached from the sleeve 12. Of course, the degree of pad 18 travel may be changed by altering the angular relationship between the plate 30 and the corresponding pad 18 surface.

Figure 3:
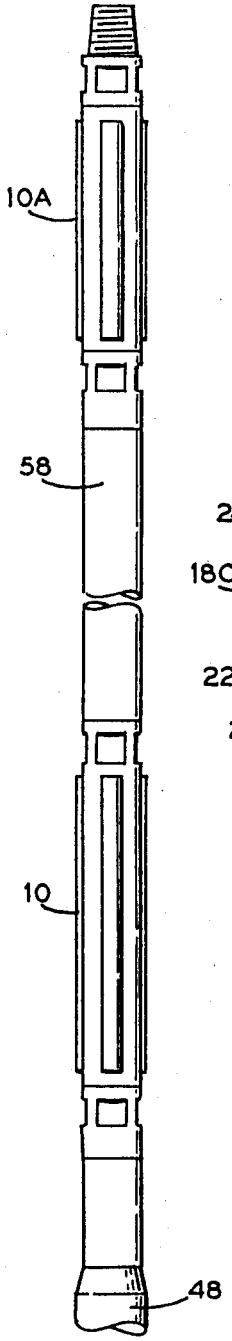
FIG. 3 is one embodiment of the invention.

The stabilizer 10 is normally used in conjunction with a rotating mandrel 34. The mandrel 34 may be either in direct or indirect rotational communication with drill bit 48 and the means (not shown) for rotating the drill bit. See FIG. 3. As a consequence, the mandrel 34 is rotatably disposed within the sleeve 12. A plurality of bearings 36 and 36A are oriented around the mandrel 34 and in registry with the internal surface of the sleeve 12 to reduce debilitating friction engendered by the rotation of the mandrel 34 within the sleeve 12. A centrally located segmented bearing or bushing 38, consisting of segments 38A, 38B and 38C in direct communication with the retainers 20, further supports the mandrel 34 within the sleeve 12.

The bearings 36 are designed to absorb any thrust loads generated by the pads 18 rubbing against the hole. The segmented bearing 38, riding on the mandrel 34, absorbs the side loads transmitted by the springs 24 through the retainers 20.

Referring to FIG. 2, the segmented bearing 38 is designed to act as a wear indicator bearing. As the individual bearing segments are worn down by the rotating mandrel 34, they may be replaced at regular intervals during periodic take down inspection of the internals of the stabilizer 10. As a consequence, it is preferred that the bearing 38 be slightly "softer" than the mandrel 34. For example, bronze has proven to be an excellent bearing material.

During initial assembly and, if necessary, periodically thereafter, grease should be applied to the bearings 36 and 38. Grease fittings 50 and 50A, oriented within the troughs 52, allow for the introduction of grease into the stabilizer 10.

The troughs 52 increase the annular surface area of the sleeve 12. By increasing the external surface area of the sleeve 12, a greater amount of cuttings are permitted to work their way away from the drill bit. Grease seals 40 and 40A, oriented towards the extremities of the cylinder 12 and in close proximity to the bearings 36, prevent grease leakage. Pin connection 42, having an optional male threaded member 46, and box connection 44, having a female threaded portion (not shown), serve to connect the stabilizer 10 and the mandrel 34 to other members (not shown) of the drill string. Both the pin connection 42 and the box connection 44 are affixed to the mandrel 34 in a known manner. Although connections 42 and 44, as shown, are equipped with wrenching slots 54 and 56 respectively, it should be appreciated that any means of connecting and fastening the stabilizer 10 and the mandrel 34 to the other members of the drill string may be utilized.

The invention and the manner of applying it may, perhaps, be better understood by a brief discussion of the principles underlying the invention.

As was discussed previously, there is a need to center and stabilize a drill bit in a hole being drilled. As a consequence, the disclosed invention was developed to overcome the wear problems associated with the stabilizers presently available.

It is preferable to orient a first stabilizer 10 near drill bit or earth-rock cutting tool 48 and stack a second stabilizer 10A some distance away from the first stabilizer 10 in order to fully utilize the invention. See FIG. 3. An extension rod 58, capable of transmitting rotational motion to the mandrel 34 and to the bit 48, may be disposed between the stabilizers 10 and 10A to form a drill stabilizing system therewith. Of course, one stabilizer or a plurality of stabilizers may be utilized depending on the circumstances.

In contradistinction to the roller type stabilizers, described previously, which rotate against the wall of the hole to stabilize the bit, the non-rotating stabilizer of the type disclosed herein merely slides against the walls of the hole in the direction of bit travel. This sliding action completely eliminates one source of pad wear, namely rotational friction. The spring-loaded pads 18 exert an equal and constant pressure against the hole wall at all times thereby ensuring drill bit stability. Instead of rotating and dragging against the walls, the pads 18 merely slide along them, reducing pad wear. In this fashion, the stabilizers self-center themselves and the bit within the hole. Furthermore, there is no torque build-up due to the pads dragging in the holes because only the mandrel 34 rotates about the bearings. The stabilizer does not rotate within the hole at all.

Moreover, it should be appreciated that the stabilizers are fully self-adjusting to accommodate the slight variations encountered in hole diameter as the bit proceeds to drill.

In addition, the stabilizer is capable of maintaining straight line drilling in holes of any given diameter and length at any angle ranging from horizontal to vertical. Furthermore, the stabilizer is not limited only to drilling operations. For example, it may be employed to stabilize reaming heads in boring operations. The stabilizer may be utilized for all types of drilling operations. Moreover, the orientation of the stabilizer is of no moment. Since it is a universal tool, there is no need to orient the stabilizer in any one particular position.

Furthermore, it should be appreciated that the stabilizier may have a greater number of pads and troughs than is shown. The number of pads is essentially a function of the size of the hole being drilled. Obviously, large diameter holes may require stabilizers with more wear-resistant pads.

Although a mechanical spring suspension system for movably supporting the pads is illustrated, a pneumatic or hydraulic system may be utilized as well. For example, a pneumatic or hydraulic piston may be employed to suspend the pads instead of the spring washers. On the other hand, if circumstances warrant, a hydraulic or pneumatic bladder, disposed between a pad and a channel, may provide the necessary reciprocating action.

While in accordance with the provisions of the statutes, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A self-centering, stabilizing apparatus comprising a fixed, non-rotating cylindrical sleeve, a mandrel rotatably disposed within the sleeve and detachably affixed therein, the sleeve having a longitudinal axis of symmetry, a plurality of bearing means disposed between the sleeve and the mandrel, a plurality of spaced, wear-resistant pads detachably affixed to the periphery of the sleeve, the pads oriented within a plurality of longitudinal channels formed along the peripheral surface of the sleeve, a plurality of alignment guides disposed within the channels and in slideable registry with the pads, a retainer projecting outwardly from each channel into a cavity formed within each pad, a spring washer disposed within each channel, the washer being oriented about the retainer, so as to allow the pads limited movement in a plane substantially perpendicular to the axis of the sleeve.

2. The combination according to claim 1 wherein at least one of the bearing means is a segmented bushing.

3. The combination according to claim 2 wherein the bushing is made from bronze.

4. The combination according to claim 1 wherein a plurality of grease seals are disposed about the mandrel and towards the ends of the sleeve to prevent the loss of grease from the bearing means.

5. The combination according to claim 1 wherein a plurality of grease fittings, disposed within the troughs, are in flow communication with the bearing means.

6. The combination according to claim 1 wherein a plurality of longitudinal troughs are formed within the peripheral surface of the sleeve and between the pads.

7. A system for stabilizing a drill string and the like in a hole, the system comprising a mandrel and at least two self-centering, non-rotating stabilizers, the stabilizers including a fixed non-rotatable cylindrical sleeve, the mandrel rotatably disposed within the sleeve and detachably affixed therein, the sleeve having a longitudinal axis of symmetry, a plurality of bearing means disposed between the sleeve and the mandrel, a plurality of spaced wear-resistant pads detachably affixed to the periphery of the sleeve, the pads oriented within a plurality of longitudinal channels formed along the peripheral surface of the sleeve, a plurality of alignment guides disposed within the channels and in slideable registry with the pads, a retainer projecting outwardly from each channel into a cavity formed within each pad, a spring washer disposed within each channel, the washer being oriented about a retainer so as to allow the pads limited movement in a plane substantially perpendicular to the axis of the sleeve, and the stabilizers arranged in a stacked, coaxial arrangement.

8. The system according to claim 7 wherein a rotatable extension member is disposed between the stabilizers.

9. The system according to claim 7 wherein an earth-rock cutting tool is disposed at one end of the drill string.

10. The system according to claim 7 wherein a stabilizer includes a plurality of longitudinal troughs formed within the peripheral surface of the sleeve and between the pads.

* * * * *